US006792692B1

(12) United States Patent
Takizawa et al.

(10) Patent No.: US 6,792,692 B1
(45) Date of Patent: Sep. 21, 2004

(54) CONTROL METHOD OF INPUT POWER AND AIRFLOW RATE OF HAIR DRYER

(75) Inventors: Noriaki Takizawa, Tokyo (JP); Feng-Chih Liao, Taichung (TW)

(73) Assignee: Manica-Thai Corp., Ltd, Pathumthani (TH)

( * ) Notice: Subject to any disclaimer, the term of this patent is extended or adjusted under 35 U.S.C. 154(b) by 0 days.

(21) Appl. No.: 10/462,632

(22) Filed: Jun. 17, 2003

(51) Int. Cl.[7] ..... A45D 20/12

(52) U.S. Cl. ..... 34/96; 34/283; 34/553; 34/554; 392/385

(58) Field of Search ..... 34/283, 553, 554, 34/565, 96, 97; 392/384, 374, 385

(56) References Cited

U.S. PATENT DOCUMENTS 4,196,343 A * 4/1980 Han ..... 392/385
4,490,602 A * 12/1984 Ishihara ..... 392/379
5,434,946 A * 7/1995 Barzilai et al. ..... 392/385
6,449,870 B1 * 9/2002 Perez et al. ..... 34/96
6,640,049 B1 * 10/2003 Lee et al. ..... 392/385

* cited by examiner

*Primary Examiner*—Ira S. Lazarus
*Assistant Examiner*—Kathryn S. O'Malley
(74) *Attorney, Agent, or Firm*—Rosenberg, Klein & Lee

(57) ABSTRACT

A hair dryer includes an air outlet portion, a holding portion, a start switch, an airflow rate control switch, an airflow rate indication portion, an input power control switch, and an input power indication portion. Thus, when the user presses the start switch, the hair dryer will start to perform with its previous setting in memory for the airflow rate and its power input. And when the user presses the airflow rate control switch or the input power control switch, the system enters the manual control mode, and is forced into the safety mode immediately, so that the user can adjust the input power and the airflow rate according to the preset safety values, thereby achieving the safe requirement.

7 Claims, 4 Drawing Sheets

| SETTING GRADE | SETTING VALUE | | CORRESPONDING SAFETY RANGE | |
|---|---|---|---|---|
| H5 | POWER INPUT | 1700W | AIR FLOW | 850 ft/min |
| H4 | | 1500W | | 850/800 ft/min |
| H3 | | 1100W | | 850/800/700 ft/min |
| H2 | | 900W | | 850/800/700/600 ft/min |
| H1 | | 600W | | 850/800/700/600/600/500 ft/min |
| A5 | AIR FLOW | 850 ft/min | POWER INPUT | 1700w/1500w/1100w/900w/600w |
| A4 | | 800 ft/min | | 1500w/1100w/900w/600w |
| A3 | | 700 ft/min | | 1100w/900w/600w |
| A2 | | 600 ft/min | | 900w/600w |
| A1 | | 500 ft/min | | 600w |

FIG.4

CONTROL METHOD OF INPUT POWER AND AIRFLOW RATE OF HAIR DRYER

BACKGROUND OF THE INVENTION

1. Field of the Invention

The present invention relates to a hair dryer, and more particularly to a control method of the input power and airflow rate of a hair dryer.

2. Description of the Related Art

A conventional hair dryer in accordance with the prior art is disclosed in the U.S. Pat. No. 6,393,718, entitled "HAND HELD HAIR DRYER". The above-mentioned conventional hair dryer comprises a negative ion generating device, a control button, and an airflow rate display. Thus, by generation of the negative ion and control of the airflow rate, the blown air has the ion effect.

SUMMARY OF THE INVENTION

The primary objective of the present invention is to provide a control method of the input power and airflow rate of a hair dryer, wherein when the user presses the airflow rate control switch or,the input power control switch, the system enters the manual control mode, and is forced into the safety mode immediately, so that the user can adjust the input power and the airflow rate according to the preset safety values, thereby achieving the safe requirement.

Another objective of the present invention is to provide a control method of the input power and airflow rate of a hair dryer, wherein the user can adjust the input power and the airflow rate according to the practical requirement, thereby facilitating the user operating the hair dryer, and thereby enhancing the versatility of the hair dryer.

Further benefits and advantages of the present invention will become apparent after a careful reading of the detailed description with appropriate reference to the accompanying drawings.

BRIEF DESCRIPTION OF THE DRAWINGS

FIG. 4 is a table of the preset safety combinations of the airflow rate and input power for controlling the input power and airflow rate of the hair dryer in accordance with the preferred embodiment of the present invention.

DETAILED DESCRIPTION OF THE INVENTION

Figure 1:
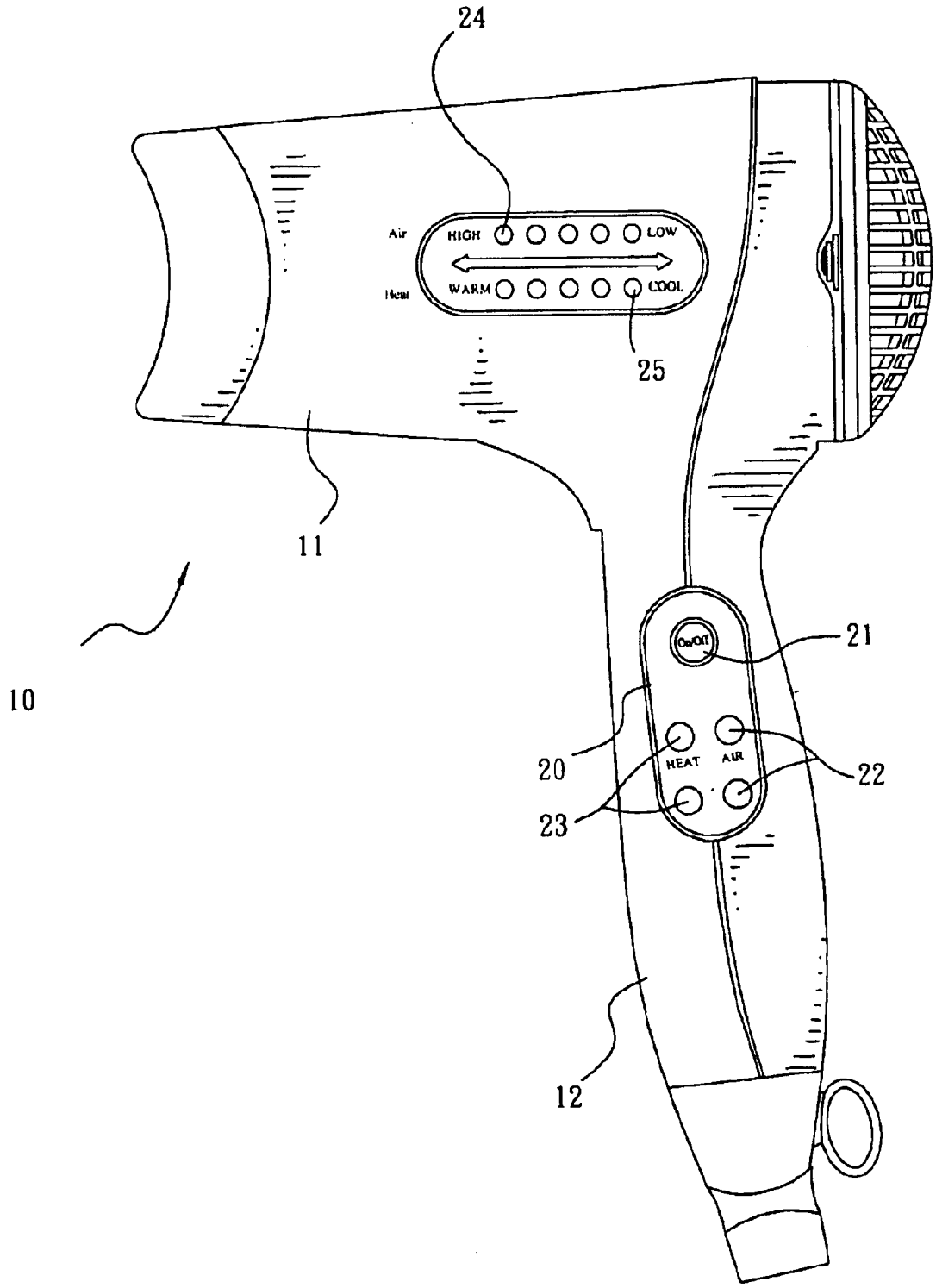
FIG. 1 is a perspective view of a hair dryer in accordance with the preferred embodiment of the present invention.
Figure 2:
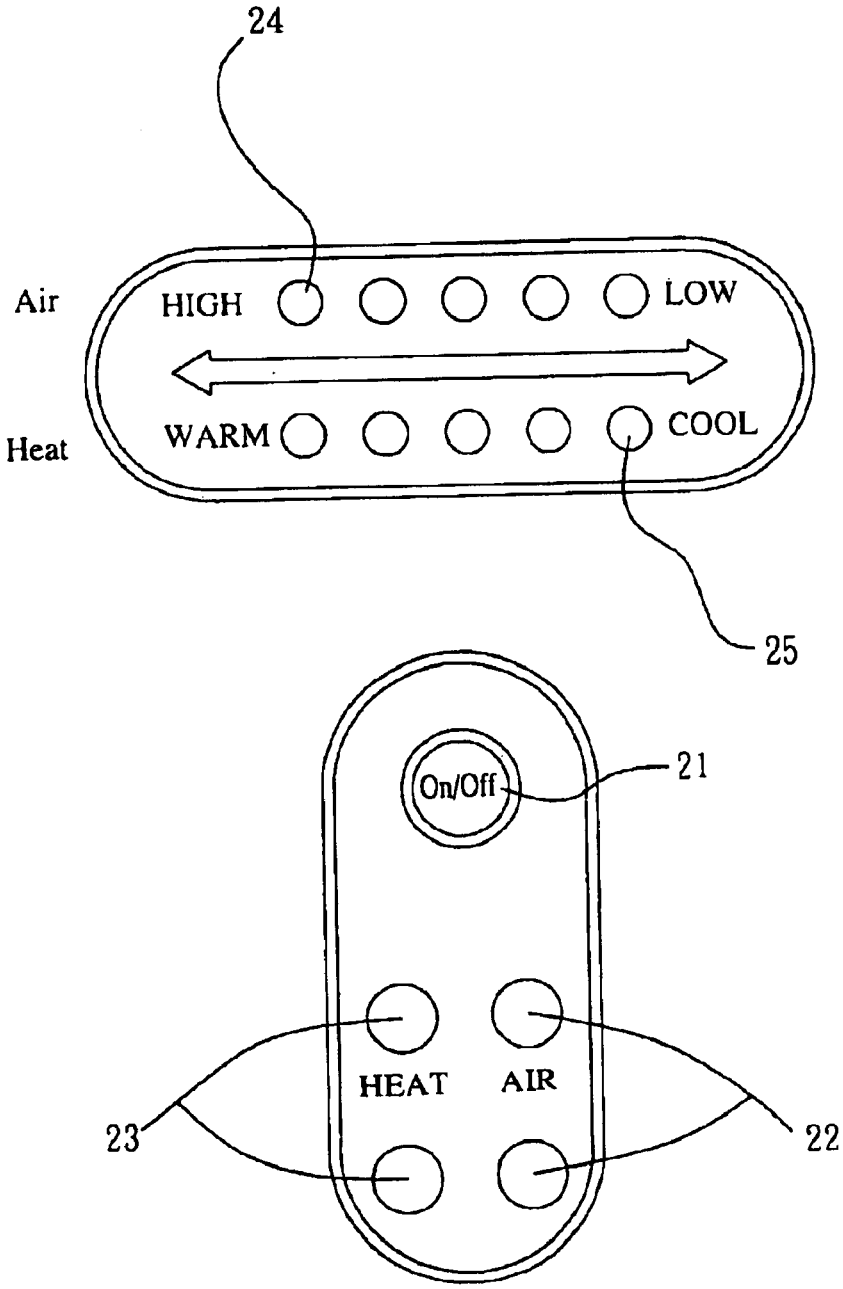
FIG. 2 is a plan view of a control panel of the hair dryer in accordance with the preferred embodiment of the present invention.

Referring to the drawings and initially to FIGS. 1 and 2, a hair dryer 10 in accordance with the preferred embodiment of the present invention comprises an air outlet portion 11, a holding portion 12, and a control panel 20 mounted on the holding portion 12.

The control panel 20 includes an On/Off switch 21, an airflow rate control switch 22, an airflow rate indication portion 24 aligning with the airflow rate control switch 22, an input power control switch 23, and an input power indication portion 25 aligning with the input power control switch 23. Preferably, each of the On/Off switch 21, the airflow rate control switch 22 and the input power control switch 23 is an electronic push button. Preferably, each of the airflow rate indication portion 24 and the input power indication portion 25 is a multi-stage light emitting diode (LED) or liquid crystal display (LCD).

Figure 3:
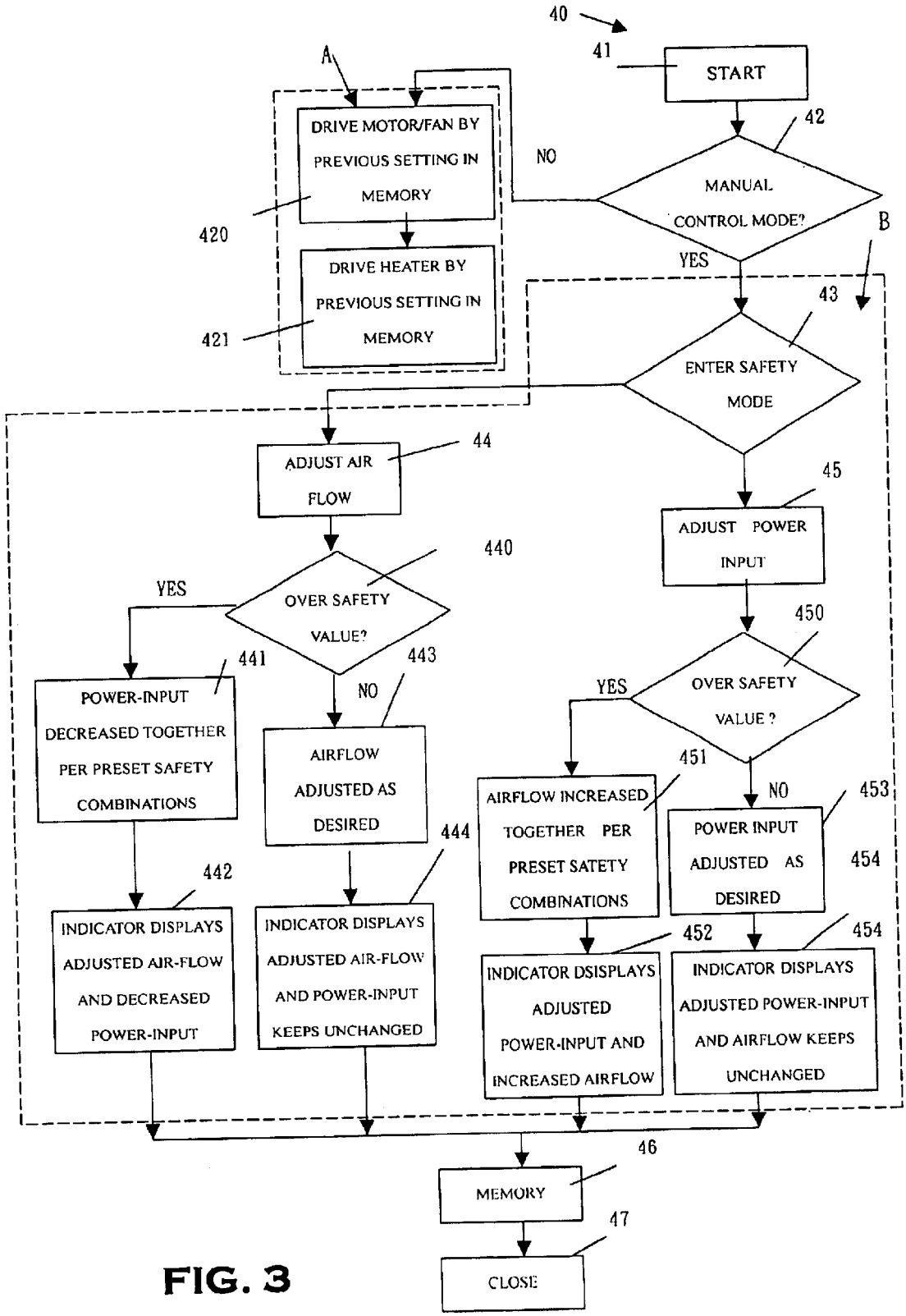
FIG. 3 is a flow chart of a control method of the input power and airflow rate of the hair dryer in accordance with the preferred embodiment of the present invention.

Referring to FIG. 3, the control procedure 40 of the control method and FIG. 4, the values of preset safety combinations of the input power and airflow rate of a hair dryer in accordance with the preferred embodiment of the present invention comprises the following steps:

Start 41: start with On/Off switch 21;

Selection 42 of the manual control mode: Judge by if the user presses the airflow rate control switch 22 or the input power control switch 23, so that if the user presses the airflow rate control switch 22 or the input power control switch 23, the procedure enters into the manual control mode B, and if the user does not press the airflow rate control switch 22 or the input power control switch 23, the procedure enters into the memory control mode A;

Enter into the memory control mode A: To drive the fan/motor 420 and the heater 421 according to the last setting in memory, so that the fan motor and the heater produce the airflow rate and input power the same as that of the last hair drying condition;

Enter into the manual control mode B: Force the procedure into the safety mode 43, so that the user can adjust the values manually in accordance with preset safety input power-airflow combinations.

Adjust the airflow rate 44: The user can press the airflow rate control switch 22 to adjust the airflow rate;

Judge the safety condition 440: The inner program simultaneously judges whether the airflow rate is adjusted per given preset safety combinations of airflow and power-input. (FIG. 4)

If airflow is adjusted within the safety range corresponding to current power-input value in preset safety power-airflow combinations, the airflow will be adjusted as desired without changing the value of input power, (442) and the LED/LCD indicator will display the adjusted airflow rate and current value of power-input (444)

If the airflow rate is adjusted lower and/or further lower, out of the safety range corresponding to current power-input value in the preset safety power-airflow combinations (FIG. 4), the airflow will be adjusted as desired, however the input power will be reduced automatically to the value corresponding to the adjusted airflow in the preset power-airflow combination (441), and the LED/LCD indicator will display the adjusted airflow and corresponding power-input. So that the airflow rate matches the input power, to prevent the temperature of the airflow from being excessively high, thereby achieving a safe purpose;

Adjust the input power 45: the user can press the input power control switch 23 to adjust the input power;

Judge the safety condition 450: The inner program simultaneously judges whether the input power is adjusted per given preset safety combinations of airflow and power-input (FIG. 4).

If the input power is adjusted within the safety range corresponding to current value of airflow in preset safety combinations of airflow-inputpower, the input power will be adjusted as desired without changing the value of the airflow (453). And the LED/LCD indicator will display the adjusted power-input and current value of airflow (454).

If the input power is adjusted exceeding the safety range corresponding to current value of airflow in preset safety airflow-inputpower combinations (FIG. 4) the value of inputpower will be adjusted as desired, however, the value of the airflow rate will be increased automatically corresponding to the adjusted value of input power preset in safety airflow-input power combinations (451). And the LED/LCD indicator will properly display the adjusted input power and corresponding airflow (452). So that the input power matches the increased airflow rate to output a proper temperature, thereby achieving a safe purpose;

Memory 46: The inner program will directly remember and store the adjusted setting; and Close 47: the user closing the start switch 21.

At the next use, if the user presses the On/Off button but does not press the airflow rate control switch 22 or the input power control switch 23, the procedure will immediately enter the memory mode, and start dryer's performance by the setting stored in memory. If the user then presses the airflow rate control switch 22 or the input power control switch 23, it will directly enter the manual control mode B, to control and produce the airflow and input power that are described as above.

As shown in FIG. 4, the safety values of the hair dryer 10 of the present invention are preset according to the principle in that when the airflow rate is low, the adjustable allowance of the input power is small relatively in the low values, and when the airflow rate is high, the adjustable allowance of the input power is big relatively from the lower to the higher values. On the other hand, when the input power is low, the adjustable allowance of the airflow rate is big relatively from the lower to the higher values, and when the input power is high, the adjustable allowance of the airflow rate is small relatively in high values.

As shown in FIG. 4, when the airflow rate is at the minimum value (500 ft/min), the corresponding input power is at the minimum value (600 w), so that the input power only has one adjustable grade (600 w), and when the airflow rate is increased, the corresponding adjustable range of input power is increased too. When it is increased to the maximum value (850 ft/min), the corresponding adjustable range of input power has five adjustable grades (1700 w/(1500 w/(1100 w/(900 w/(600 w).

On the other hand, when the input power is at the maximum value (1700 w), the corresponding airflow rate is at the maximum value (850 ft/min), so that the airflow rate only has one adjustable grade(850 ft/min), and when the input power is decreased, the corresponding adjustable range of airflow is increased, and when it is at the minimum value (600 w), the corresponding adjustable range of airflow rate has five adjustable grades (850/800/700/600/500 ft/min).

For example, when the airflow rate is at the lower grade A2 600 ft/min), the input power only has two adjustable grades (900 w/600 w). Thus, when the user performs the step of adjusting the input power 45 as shown in FIG. 3, the input power only has two adjustable grades (900 w/600 w). If the desired and thus adjusted input power exceeds the two adjustable grades (900 w/600 w), the desired input power is greater than the safety value 450, so that the value of the airflow rate is increased automatically 451as per given safety airflow-power combinations, and the adjusted power input and the corresponding airflow rate are indicated simultaneously 452, thereby achieving the safe purpose.

Similarly, when the input power is at the higher grade H4 (1500 w), the safety values of the airflow rate only has two adjustable grades (850/800 ft/min). Thus, when the user performs the step of adjusting the airflow rate 44 as shown FIG. 3, the airflow rate only has two adjustable grades 850/800 ft/min). If the desired and thus adjusted airflow rate gets out of the safety range of the two adjustable grades (850/800 ft/min), the desired airflow rate is lower than the safety value (440), so that the value of the input power will be decreased automatically as per given safety value combinations (441), and the adjusted airflow and the corresponding input power are indicated simultaneously 442, thereby achieving the safe purpose.

In addition, the user can adjust the input power and the airflow rate according to the practical requirement, thereby facilitating the user operating the hair dryer, and thereby enhancing the versatility of the hair dryer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hair dryer, comprising:

an air outlet portion;

a holding portion;

a start switch;

an airflow rate control switch;

an airflow rate indication portion aligning with the airflow rate control switch;

an input power control switch; and an input power indication portion aligning with the input power control switch, each of the airflow rate indication portion and the input power indication portion being a multi-stage light emitting diode (LED).

2. The hair dryer in accordance with claim 1, wherein the start switch, the airflow rate control switch, the airflow rate indication portion, the input power control switch, and the input power indication portion are mounted on a control panel.

3. The hair dryer in accordance with claim 1, wherein each of the start switch, the airflow rate control switch and the input power control switch is an electronic push button.

4. A hair dryer comprising:

an air outlet portion;

a holding portion;

a start switch;

an airflow rate control switch;

an airflow rate indication portion aligning with the airflow rate control switch;

an input power control switch; and an input power indication portion aligning with the input power control switch, each of the airflow rate indication portion and the input power indication portion being a liquid crystal display (LCD).

5. The hair dryer in accordance with claim 1, wherein:

the start switch is pressed by a user to turn on or turn off an electric power;

the airflow rate control switch is pressed by the user to enter a manual control mode to adjust an airflow rate and to output a safety input power corresponding to the adjusted airflow rate;

the input power control switch is pressed by the user to enter the manual control mode to adjust an input power and to output a safety airflow rate corresponding to the adjusted input power;

the airflow rate indication portion is used to indicate the airflow rate; and the input power indication portion is used to indicate the input power.

6. A control method of the input power and airflow rate of the hair dryer in accordance with claim 1, comprising:

a memory control mode step, the memory control mode step including the step of entering a memory control mode when both of the airflow rate control switch and the input power control switch are not pressed by the user after the start switch is pressed so as to obtain previous setting values in a memory and to drive a fan/motor and a heater to operate according to the previous setting values, so that the fan/motor and the heater produce the airflow rate and input power the same as that of the previous hair drying condition; and a safety mode step.

7. The control method of the input power and airflow rate of the hair dryer in accordance with claim 6, wherein the safety mode step includes judging if the corresponding airflow rate and input power match given preset safety airflow/input power values when either one of the airflow rate control switch or the input power control switch is pressed by the user after the start switch is pressed so as to adjust the corresponding airflow rate and input power according to the given preset safety airflow/input power values.

* * * * *